United States Patent [19]

Lardner et al.

[11] Patent Number: 4,505,312

[45] Date of Patent: Mar. 19, 1985

[54] FILLING AN AIR VENTING CLOSURE

[75] Inventors: George S. Lardner, St. Petersburg; John S. TenBarge, Indian Rocks Beach, both of Fla.

[73] Assignee: Halkey-Roberts Corp., St. Petersburg, Fla.

[21] Appl. No.: 491,418

[22] Filed: May 4, 1983

[51] Int. Cl.[3] ..... B65B 3/04

[52] U.S. Cl. ..... 141/326; 141/285; 141/392; 220/373; 222/527; 222/528

[58] Field of Search ..... 141/98, 285, 1-12, 141/392; 220/373, 200; 222/527, 528, 530, 538; 138/89

[56] References Cited

U.S. PATENT DOCUMENTS

| | | | |
|---|---|---|---|
| 3,628,705 | 12/1971 | Rieke | 222/527 |
| 4,136,796 | 1/1979 | Dubois et al. | 220/373 |
| 4,442,949 | 4/1984 | Dwinell et al. | 222/527 |

FOREIGN PATENT DOCUMENTS

| | | | |
|---|---|---|---|
| 688531 | 3/1953 | United Kingdom | 222/527 |

*Primary Examiner*—Houston S. Bell, Jr.

[57] ABSTRACT

A filling, emptying, and air venting closure for a liquid containing hollow article having a flexible wall, and the combination of the closure with such article. The closure has a hollow stem having a root and a free outer end, a sheet-like member sealingly attached to the root of the stem being adapted for sealing attachment to the flexible wall of the inflatable article. The sheet-like member is selectively deformable to allow the stem to be removed from a first position, in which it lies inwardly of the outline of the hollow article, into a second position in which it protrudes from the flexible wall of the article to which it is attached and is disposed in a second position, generally at right angles to its first position. The stem has a threaded outer end on which there is removably mounted a partial closure device having a gas preminable member which provides for the passage of a gas outwardly therethrough from the interior of the hollow article, said gas preminable device being impreminable to liquid.

13 Claims, 6 Drawing Figures

FILLING AN AIR VENTING CLOSURE

This invention relates to a closure for filling, air venting, and emptying a liquid inflatable flexible walled article, and to the combination of the closure with such article. One such inflatable article is a waterbed or water mattress with which the invention is illustrated herein.

A waterbed or water mattress uses water as the conforming medium, as opposed to a mattress using springs and stuffing as the conforming medium. The apparatus of the present invention not only permits the filling of an inflatable article with a liquid such as water and the emptying of the liquid from the article, but also automatically and continuously vents and traps air or other gas from the article. The invention can also be applied to other liquid containing inflatable articles such as fuel containers in which entrapped air or other gases are undesirable.

Waterbeds have been previously filled and drained using a sealable valve which can be extended out to perform the filling and draining functions. One such waterbed and valve combination is shown in Canadian Pat. No. 364,779 to Chamberland. This valve is designed in such a way that it is flush with the surface of the waterbed when it is in normal position, thereby causing no discomfort to the occupants of the waterbed. Water which is used to fill the waterbed, however, has air diffused in it. Over a long period of use, this air comes out of solution and forms a pocket at the top of the water in the mattress. This air causes noise (sloshing), and floppiness of the mattress. It is therefore necessary to blend the air out of the waterbed, as it accumulates. With the existing waterbed valve, this entails taking all of the bedding off the mattress, pulling up the valve, screwing the closure of the valve to open it slightly, and working the air in the mattress toward the valve in order to vent it. The cap on the valve is then retightened, the valve is then pushed back down, and the bedding is replaced on the mattress.

The above difficulties are overcome by the filling, air venting, and emptying closure of the present invention. In accordance with a preferred embodiment of closure, a recess is provided in the waterbed in an edge thereof and preferably near the foot of the bed, the recess being made up partially by a cut-out portion in the vertical side wall of the mattress and partially by a cut-out in the top horizontal portion of the warterbed. The valve has a closure stem from the root of which there extends a flexible sheet-like hood integral with the stem, the hood being of such shape as to fit within the recess in the side and top walls of the waterbed and to be sealed thereto around the edge of the recess. When the closure is in its first, stable normal position, the closure stem extends substantially horizontal and completely within the hood of the closure which itself lies completely within the recess in the waterbed with the exception of a flange which extends peripherally of the hood of the closure and is sealed to the edge of the cut-out portions thereof which constitute the recess in the waterbed.

The closure is completed by a cap which is screwed onto the outer end of the valve stem, cap including a gas permeable membrane which is impervious to water. In other words, the properties of the gas permeable membrane are such that they will allow gas to pass freely through the membrane, while retaining water. The upper inner portion of the valve stem when in horizontal position lies practically at the top of the waterbed, so that there is constantly provided free access of any air in the water in the waterbed to the atmosphere. Thus when the waterbed is in use the valve provides for the constant venting of any air therein to the atmosphere without requiring the user to take any steps whatsoever to make such venting possible.

When it is desired to fill the waterbed with water the stem of the valve is turned to a second stable position in which it lies substantially vertical with the screw threaded upper end of the stem extending a substantial distance above the upper surface of the waterbed. The cap can then be removed from the stem and a filling hose attached thereto. Following the filling of the waterbed, the hose is unscrewed from the stem and the cap is reapplied thereto. The stem can then be turned into its normal, horizontal position in which it lies wholly within the recess in the waterbed.

The invention will be more readily understood upon consideration of the accompanying drawings, in which.

Figure 1:
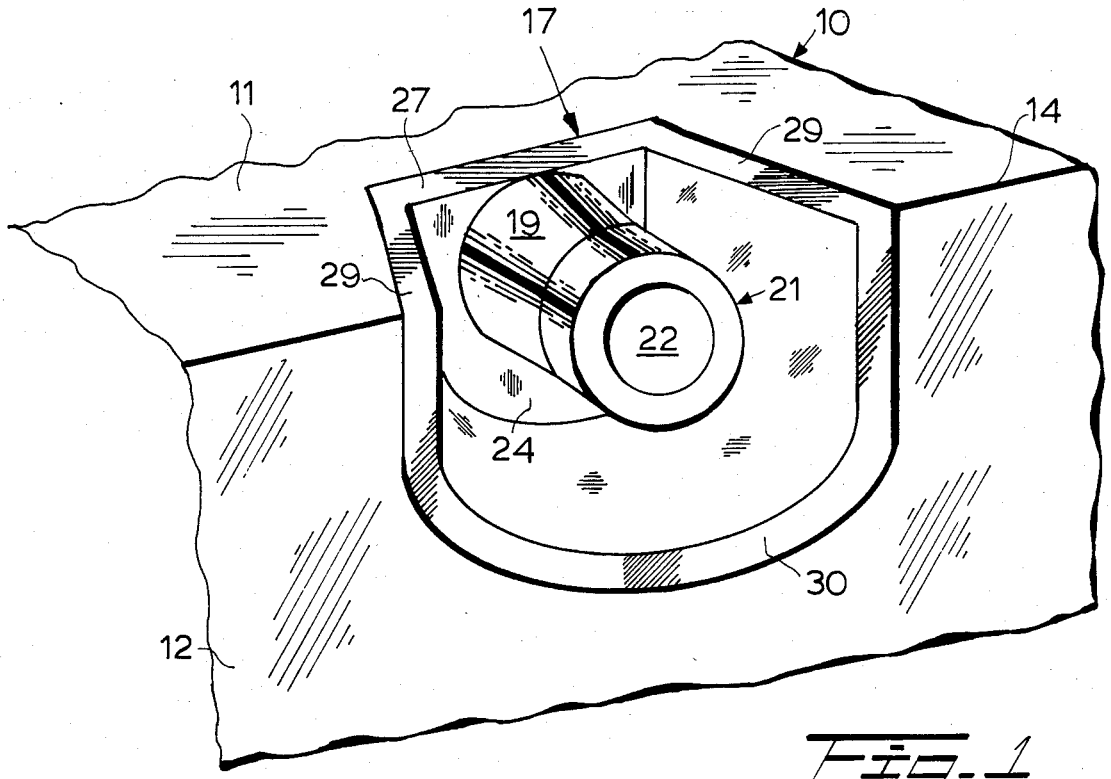
FIG. 1 is a fragmentary view in perspective showing a portion of a waterbed in which there is mounted a closure in accordance with the present invention, such closure being in its normal or horizontal condition entirely contained within a recess in the waterbed.
Figure 2:
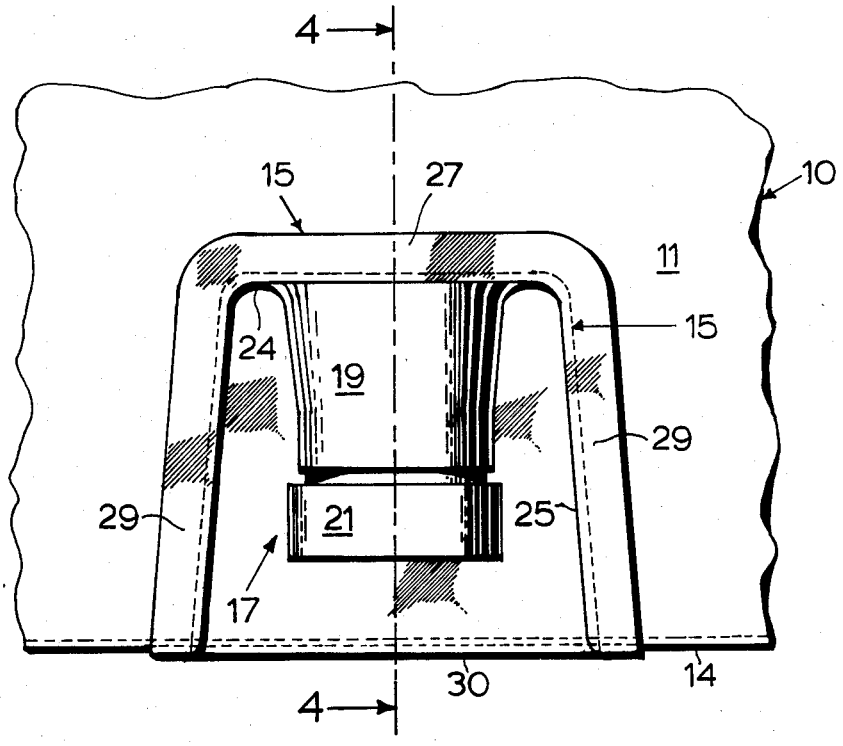
FIG. 2 is a view in plan of the portion of the waterbed with the closure in the position thereof shown in FIG. 1.
Figure 3:
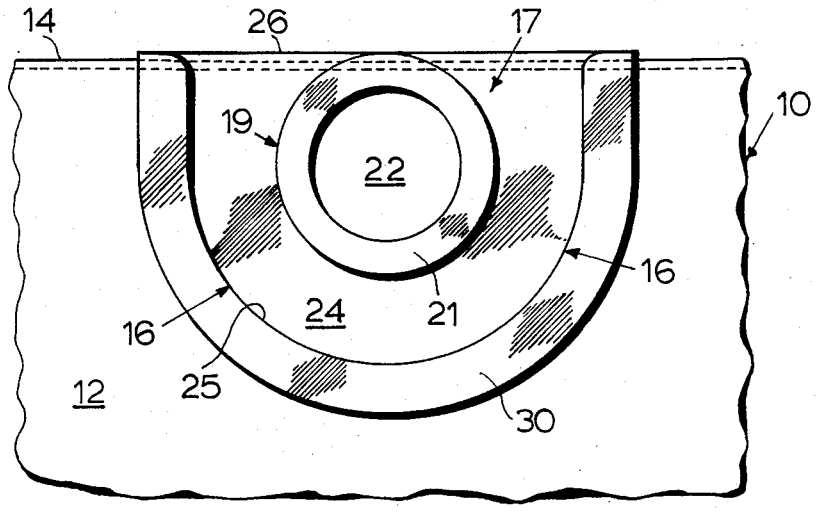
FIG. 3 is a view in side elevation of the arrangement shown in FIGS. 1 and 2, the view being taken in an upward direction in FIG. 2.

In the drawings there is shown a portion of a waterbed which is generally designated by the reference character 10. The waterbed has a top ply 11 and a side ply 12, such plies being joined at an upper side edge 14. The part of the waterbed shown is provided with a recess having an upper portion 15 which is in the form of a cut-out in the top ply 11 of the waterbed, and a portion 16, which is the form of a cut-out in the side ply 12 of the waterbed. Such cut-outs merge and together form one single cut-out having a top horizontal portion and a side vertical portion. The filling, venting, and emptying closure of the invention is generally designated 17. Such valve is shown in FIGS. 1, 2, 3 and 4 in its "normal" or horizontal position, and in FIGS. 5 and 6 in its vertical, filling and emptying position.

Valve 17 has a valve stem 19 the outer end of which is threaded as shown at 20. Threaded portion 20 of the stem receives a cap 21 which has as an insert a disc 22 made of a plastic material which is permeable to air but is impermeable to water. Thus when the valve is in the position thereof shown in FIGS. 1–4, incl., the stem 19 remains constantly open for the discharge therefrom of any air bubbles in the water in the waterbed, the insert 21 preventing the leakage of water therethrough. Insert 22 is made of micro-porous plastic such as "Teflon", which is presently available from several manufacturers. One such supplier of such gas permeable membrane ia Laboratoire Osmoco Laboratory, 8 rue Victoria, Pointe Claire, Quebec, Canada.

The closure body, which includes the valve stem 19 and a relatively thin sheet of flexible plastic material in the form of a hood molded integral with the stem may be made of a suitable flexible plastic sheet material such as polyvinylchloride. The cap 21 may be made of a suitable plastic material such as polyethylene although polypropylene could also be used for this purpose. The closure body made up of the stem 19 and the hood 23 is molded in the condition thereof shown in FIGS. 1–4, incl., and stably remains in such condition until the stem 19 is deliberately raised and turned into the vertical position thereof shown in FIGS. 5 and 6, in which the stem is also stably retained. When the closure is in its normal position a part of the hood 23 forms itself into a part-toroidal surface 24 at the root of the closure stem 19. The remainder of the hood, which extends from surface 24 outwardly to the side wall 12 of the waterbed, is in the form of a part of a frustum of a cone which is generally coaxial with the stem 19. The rear or inner upper part of portion 25 of the side wall is terminated by a straight line 26. The remainder of the closure is in the form of a flange which extends continuously about the hood of the closure, such flange having a top portion 27 which overlies the edges of the cut-out 15 in the upper ply of the waterbed and a front flange part 30 which is part-circular in shape and overlies the vertical side ply 12 of the waterbed. The flange is sealed to the edges of the recess in the waterbed, either being glued thereto or heat sealed thereto.

Figure 4:
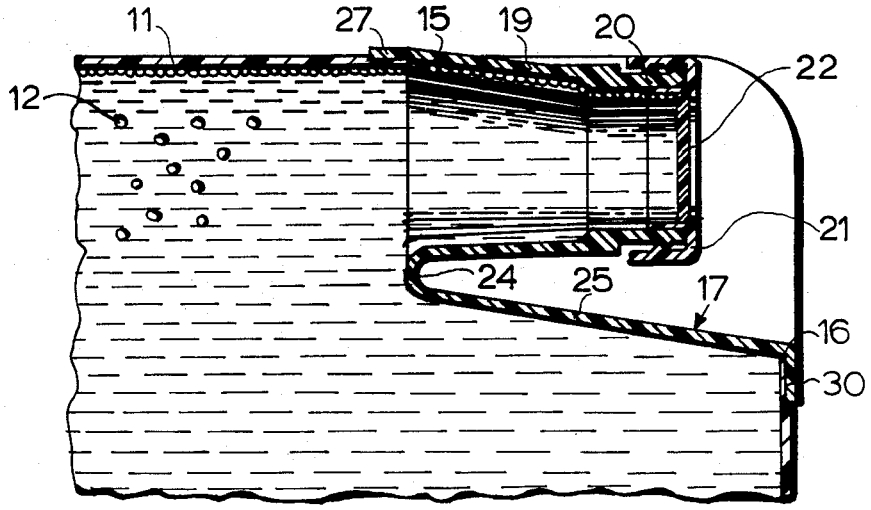
FIG. 4 is a fragmentary view in cross-section through the arrangement of FIGS. 1–3, incl., the section being taken along the line 4—4 in FIG. 3.
Figure 5:
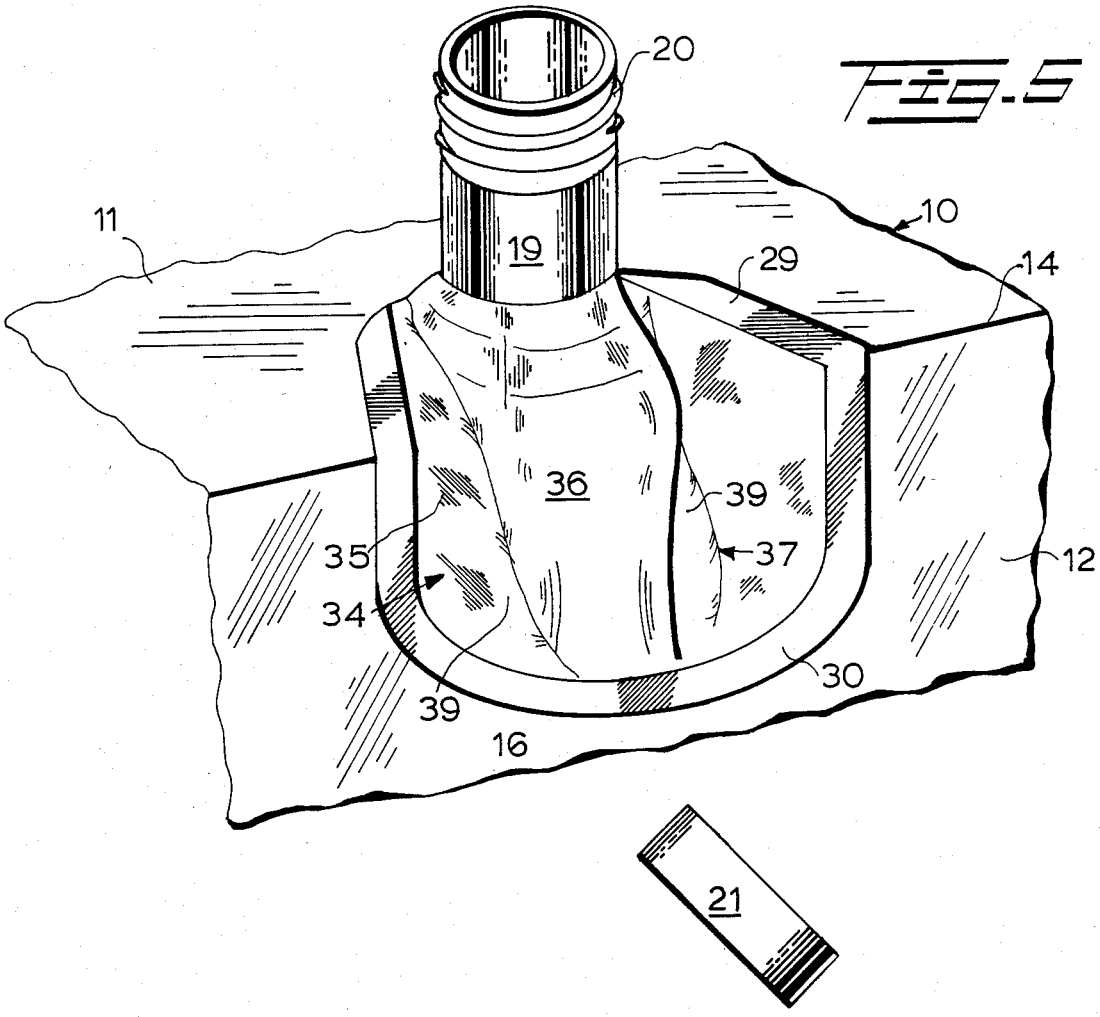
FIG. 5 is a view in perspective of the arrangement shown in FIG. 1 but with the stem of the closure having been turned to lie in a vertical direction, as for the filling of the mattress with water.
Figure 6:
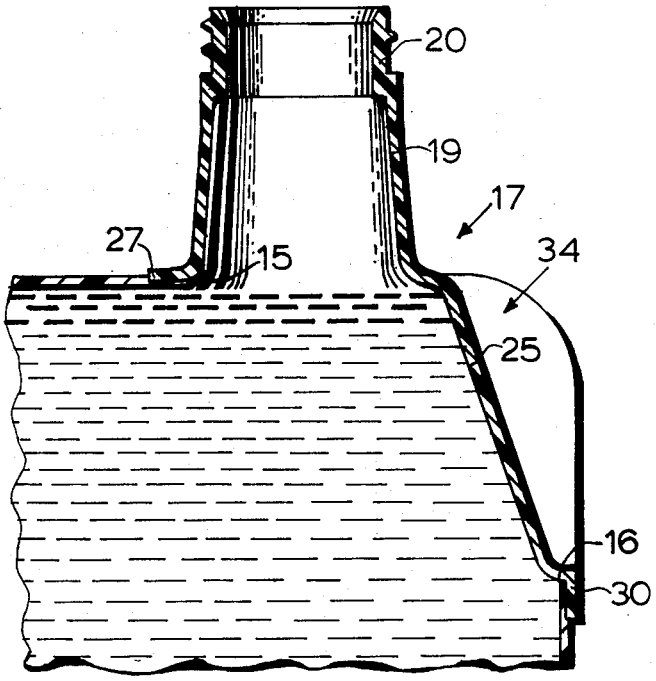
FIG. 6 is a view in vertical axial section through the valve and waterbed with the valve stem turned into its vertical position, the section being taken along the line 6—6 in FIG. 5.

When it is desired to fill the waterbed with water, the stem 19 of the closure is pulled upwardly from its normal, horizontal position into the vertical position thereof shown in FIGS. 5 and 6. The closure body has as a whole turns about the line 26; such action will be clear when comparing the configuration of the closure shown in FIG. 4 with that shown in FIG. 6. The hood portion 25 of the closure, which in FIG. 4 is in the shape of a part of a frustum of a cone, when the closure is changed into the condition of FIG. 6 is deformed into a shape generally designated 34 having a reverse fold formation, which is best seen generally as a whole in FIG. 5. Formation 34 (FIG. 5) has a left fold disposed in the direction into the paper, a center fold 36, which extends in a direction outwardly from the paper, and a right fold 37 which is similar to fold 35 and extends in a direction into the paper. At the root of the stem 19 the closure in the configuration thereof shown in FIG. 6 has the hood portion 25 slightly necked in toward each other on opposite sides of the stem.

The valve of the present invention provides for the emptying of the waterbed by the attachment of a hose to the end of the stem 19 after having removed the cap 21, and then turning the waterbed so that the closure is disposed in a lower portion of the waterbed.

The closure of the present invention has the further advantage that the stem 19 and the hood which together form the closure occupy more space within the waterbed when the closure is disposed in its "normal" horizontal position (FIG. 4) than it does when the closure is disposed in its vertical extended position (FIG. 6). Thus waterbed can be filled with water, with the closure in its FIG. 6 position, to the extent that water will extend upwardly within the stem 19, preferably to the top thereof. Upon then disconnecting the filling hose, applying the cap 21 with its insert 22, and folding the closure downwardly and inwardly from the position of FIG. 6 to that of FIG. 4 the water in the waterbed will be subjected to a pressure somewhat greater than atmospheric pressure, thereby at least slightly extending the top, bottom and side walls of the waterbed. Thus even though air is subsequently expelled from the waterbed through the semi-permeable membrane insert 22 the waterbed will remain, to all intents and purposes, filled with water and thus retain its normal body supporting and conforming properties over long periods of time without the need of any further attention.

Although the invention is described and illustrated with reference to a single preferred embodiment thereof, it is to be expressly understood that it is in no way limited to the disclosure of such preferred embodiment but is capable of numerous modification within the scope of the appended claims.

We claim:

1. A filling, emptying, and air venting closure for a liquid-containing hollow article having a flexible wall, comprising a hollow stem having a root and a free outer end, a sheet-like member sealingly attached to the root of the stem adapted for sealing engagement to the flexible wall of an inflatable article, the stem and the sheet-like member being made as an integrally-molded plastic article, the sheet-like member having a perimeter in the form of a flange spaced from and surrounding the root of the stem, said flange being adapted to be sealed to the wall of an inflatable article at an opening therein, said opening being disposed partly in a first, generally flat surface of the inflatable article and partly in a second surface of the inflatable article which is disposed generally at right angles to the first said surface of the inflatable article, the perimeter of the sheet-like member being divided into two major portions which are disposed in planes disposed generally at right angles with respect to each other, both when the stem and the sheet-like member are disposed in a first position, and in their second position wherein the stem is disposed generally at right angles to the axis thereof in the position which it occupies when it is disposed in its first position, and partial closure means removably connected to the outer end of the stem, said partial closure means comprising gas-permeable means which provides for the passage of a gas outwardly therethrough from the interior of the hollow article, said gas-permeable means being impermeable to liquid.

2. The closure according to claim 1, wherein the outer free end of the stem is threaded, and the partial closure means is screwed upon the outer end of the stem and sealed thereto.

3. The closure according to claim 1, wherein the valve was molded with the parts thereof in said first position.

4. The closure according to claim 1, wherein when the stem and the sheet-like member are disposed in their first positions, a predominant part of the sheet-like member forms a generally part-circular cylinder coaxial of the stem.

5. The closure according to claim 4, wherein when the stem and the sheet-like member are disposed in their second position, the root of the stem lies generally at the level of the parallel edges of the part-circular cylinder a predominant part of which the sheet-like member forms when the stem and the sheet-like member are in their first position.

6. The closure according to claim 4, wherein when the stem and the sheet-like member are disposed in their second positions, the sheet-like member is deformed from its first position into a second position wherein it has three laterally spaced first folds which are generally parallel to the stem and are convex in a direction away from the stem, and said three first folds are separated from each other by two second folds which are generally parallel to said first three folds and are convex in a direction opposite from the first folds, a respective second fold being disposed between the fold of each pair of consecutive first folds.

7. The combination of a liquid containing hollow article having a flexible wall and a filling, emptying, and air venting closure mounted thereon, the closure comprising a hollow stem having a root and a free outer end, a sheet-like member sealingly attached to the root of the stem and sealingly attached to the flexible wall of the inflatable article, the stem and the sheet-like member of the valve being made as an integrally molded plastic article, the sheet-like member having a perimeter in the form of a flange spaced from and surrounding the root of the stem, said flange being sealed to the wall of the inflatable article at an opening therein, the perimeter being divided into two major portions which are disposed in planes disposed at right angles with respect to each other both when the stem and the sheet-like member are disposed in a first position, and in their second position wherein the stem is disposed generally at right angles to the position thereof which it occupies when it is disposed in its first position.

8. The combination according to claim 7, wherein the closure was molded with the parts therof in said first position.

9. The combination according to claim 7, wherein when the stem and the sheet-like member are disposed in their first position a predominant part of the sheet-like member forms a generally part-circular cylinder coaxial of the stem.

10. The combination according to claim 7, wherein the inflatable hollow article is a waterbed, the waterbed has an upper and a side ply, and the closure is mounted in a recess which is located at the intersection between the upper and said side ply of the waterbed.

11. The combination according to claim 10, wherein when the stem and the sheet-like member are disposed in their first position a predominant part of the sheet-like member forms a generally part-circular cylinder coaxial of the stem, and the stem lies wholly beneath the upper ply of the waterbed.

12. The combination according to claim 11, wherein when the stem and the sheet-like member are disposed in their second position, the root of the stem lies generally at the level of the upper ply of the waterbed, and the remainder of the stem extends upwardly above and substantially normal to the upper ply of the waterbed.

13. The combination according to claim 12, wherein the closure displaces more liquid from the interior of the waterbed when the closure is in its first position than it does when the value is in its second position.

* * * * *